United States Patent [19]

Camus

[11] Patent Number: 4,531,037

[45] Date of Patent: Jul. 23, 1985

[54] PROCESS AND MEANS TO CONTROL THE AVERAGE HEATING POWER INDUCED IN A FLAT CONDUCTING PRODUCT MAINTAINED ELECTROMAGNETICALLY IN POSITION WITHOUT CONTACT

[75] Inventor: Jean-Paul Camus, Mantes La Jolie, France

[73] Assignee: CEM Compagnie Electro-Mecanique, Paris, France

[21] Appl. No.: 464,948

[22] Filed: Feb. 8, 1983

[30] Foreign Application Priority Data

Mar. 12, 1982 [FR] France ..... 82 04181

[51] Int. Cl.[3] ..... H05B 5/00; H05B 6/00

[52] U.S. Cl. ..... 219/10.75; 219/10.41; 219/10.61 R; 219/10.77

[58] Field of Search ..... 219/7.5, 10.41, 10.71, 219/10.75, 10.61 R, 10.67, 10.77

[56] References Cited

U.S. PATENT DOCUMENTS

| | | | |
|---|---|---|---|
| 3,041,434 | 6/1962 | Alf | 219/10.61 |
| 4,122,321 | 10/1978 | Cachat | 219/10.71 X |
| 4,296,298 | 10/1981 | MacMaster et al. | 219/10.75 X |
| 4,321,444 | 3/1982 | Davies | 219/10.71 X |

FOREIGN PATENT DOCUMENTS

| | | |
|---|---|---|
| 2609978 | of 0000 | Fed. Rep. of Germany . |
| 903847 | 12/1953 | Fed. Rep. of Germany . |
| 2622825 | 12/1977 | Fed. Rep. of Germany . |
| 1389902 | 12/1965 | France . |
| 1576364 | 8/1969 | France . |

*Primary Examiner*—Roy N. Envall, Jr.
*Assistant Examiner*—Marvin M. Lateef
*Attorney, Agent, or Firm*—Burns, Doane, Swecker & Mathis

[57] ABSTRACT

A method and system for controlling the heating of a product in an electromagnetic induction heating installation having a pair of essentially identical inductors placed on either side of the product with the poles of one of the inductors of the pair facing the poles of the other inductor. The average heating power electromagnetically induced in a moving or stationary, flat, conducting product positioned without contact by electromagnetic forces correlatively induced by the electromagnetic heating field is controlled by effecting a sequence of inversions of the instantaneous polarity of the poles of one of the inductors with respect to the instantaneous polarity of the corresponding poles of the other inductor. The ratio of the durations during which the polarities are on the one hand opposite and on the other identical determines the average value desired of the heating power induced, and the position of the product remaining practically unchanged by said inversions. The average heating power induced may be controlled by the inversions to effect a reduction of the heating power at the end of heating to thereby effect a reduction of dynamic temperature deviations due to the non-uniform distribution of the densities of the current induced.

5 Claims, 4 Drawing Figures

PROCESS AND MEANS TO CONTROL THE AVERAGE HEATING POWER INDUCED IN A FLAT CONDUCTING PRODUCT MAINTAINED ELECTROMAGNETICALLY IN POSITION WITHOUT CONTACT

BACKGROUND OF THE INVENTION

The present invention relates to a method and apparatus for controlling the average heating power induced by an electromagnetic field in a moving or stationary, flat conducting product while maintaining the product in position (e.g. while levitating or guiding the product) without contact, by electromagnetic forces also induced by the heat inducing field, particularly in an electromagnetic heating installation comprising a pair of essentially identical inductors having poles facing each other in pairs on either side of the product.

In various finishing operations and especially in certain heat treatment processes, it may be necessary to regulate the power induced in a product in order to follow a predetermined temperature curve as a function of time, while maintaining the position of the product without contact, for example in levitation.

It is obvious that to reduce the power induced in a product exposed to a transverse flux, it may be sufficient to reduce the intensity of the current flowing through the inductors creating the flux, but when the product is in levitation with conventional devices, the reduction involves a reduction in the height of levitation. Furthermore, if it is desired to position the product without contact, the reduction in power is necessarily related to the need to maintain the height of levitation at a minimum value.

The object of the present invention is to control over the broadest range possible the heating power electromagnetically induced in a flat, conducting product supported without contact (e.g. in levitation or guidance), by the correlatively induced electromagnetic forces, while insuring an essentially constant position of the product and by using a simple and economical apparatus.

It is known that in an electromagnetic heating installation with transverse flux, comprising a pair of identical inductors placed on either side of a product supported electromagnetically without contact with the poles of one of the inductors of the pair facing the poles of the other inductor and supplied with, for example, a single phase alternating current, the power induced in the product is at a maximum when the poles facing each other in pairs are at all times at opposite magnetic polarities and when the magnetic flux intensities passing through the inductors are at a maximum. But it is also known that the power induced is nearly annulled (for example at a ratio of 1000 to 1) when the poles facing each other in pairs are at all times of the same polarity and when the magnetic flux intensities passing through the inductors are at a maximum. This phenomenon and an apparatus operating in this manner are more fully described in a U.S. patent application by Jean-Claude Bronner for "Method And Apparatus For Minimizing The Power Induced In A Flat Conducting Product Maintained In Position Electromagnetically Without Contact, Ser. No. 464,952," filed concurrently herewith, assigned to the assignee of the present invention and hereby incorporated herein by reference.

The process according to the invention, for controlling the heating power induced by an electromagnetic field in a flat, conducting product supported without contact by the electromagnetic forces correlatively induced by the heat inducing field, involves an installation for heating by electromagnetic induction wherein an essentially identical pair of inductors are placed on either side of the product with the poles of one inductor of the pair facing the poles of the other inductor. A sequence of inversions of the instantaneous polarity of the poles of one of the inductors with respect to the instantaneous polarity of the corresponding poles of the other inductor is effected, with the ratio of the durations during which the magnetic polarities of the poles of the one inductor are on the one hand opposite and on the other identical to the magnetic polarities of the corresponding poles of the other inductor, determining the average value of the heating power induced, the position of the product remaining practically constant.

In actual fact, by means of calculations and by experiments, the present applicant has discovered that quite unexpectedly, the electromagnetic forces applied to the product and which maintain it without contact, remain essentially the same whether the instantaneous magnetic polarities of the pairs of inductor poles facing each other are all identical or all opposite, all other conditions being equal, and that during an inversion of the relative polarity of the poles of one of the inductors with respect to the polarity of the corresponding poles of the other inductor, the position of the product remains practically unchanged.

One of the advantages of the process according to the invention originates in the fact that the distances separating the polar surfaces of each pair of poles facing each other from either side of the product, may be reduced to a minimum corresponding to the space required by the overall dimensions in thickness of the product taking into account its deformations and possible existing thermal insulation, with the clearance needed to insure the absence of contact being nearly zero. The yield and the power factor of the means effecting the process are thereby improved.

This simple and economical process is applicable particularly to the reduction of the power induced at the end of heating. As dynamic temperature deviations are proportional to the power induced in relation to the product volume and result both from conduction phenomena and the not perfectly uniform distribution of the current densities induced, this reduction in power makes it possible to obtain smaller dynamic temperature deviations and thus, for example, to attain a relatively uniform average temperature in the product without locally exceeding the temperature limit to be observed.

The invention is applicable especially to installations for heating in levitation, for example heating with electromagnetic guidance, where it is necessary to maintain essentially constant forces tending to return the product toward a position of equilibrium.

The invention further concerns an apparatus for controlling the average power induced electromagnetically in a flat, conducting product, maintained without contact in an essentially constant position by correlatively induced electromagnetic forces, the apparatus effecting the process according to the invention and comprising a means to invert the magnetic polarity of selected poles of inductors on either side of the product, the apparatus further including, depending on the particular case:

a control system;

means to sense the temperature of the product;
means to sense the power induced;
means defining a power cycle to be effected;
means defining a temperature cycle to be effected;
the information, results and data obtained by the foregoing means, together with the properties of the product which are determinative of its induction heating characteristics being taken into account by the control system in order to control the heating of the product.

The inversions of the instantaneous magnetic polarity of the poles of one of the inductors with respect to the instantaneous magnetic polarity of the corresponding poles of the inductor are accomplished in any suitable, conventional manner by a polarity inverter performing, for example, an inversion of the supply line of one of the inductors at the alternating source of current or potential (the potential/current ratio is different according to whether the polarities are identical or opposed).

A device according to the invention includes, in an alternate embodiment, a conventional electronic curve generating and following circuitry such as a cyclic ratio generator, the frequency of which is a function of the precision of control desired, in order to make it possible to observe in a rigorous fashion a predetermined curve as a function of time.

In accordance with a preferred embodiment, the polarity inverter is of the static type, comprising two rectifier bridges connected so as to be individually selectable to supply power to the coils of the inductor poles.

BRIEF DESCRIPTION OF THE DRAWINGS

The characteristics and advantages of the present invention will become more apparent from the description hereinafter with regard to the drawings attached wherein.

DETAILED DESCRIPTION

Figure 1:
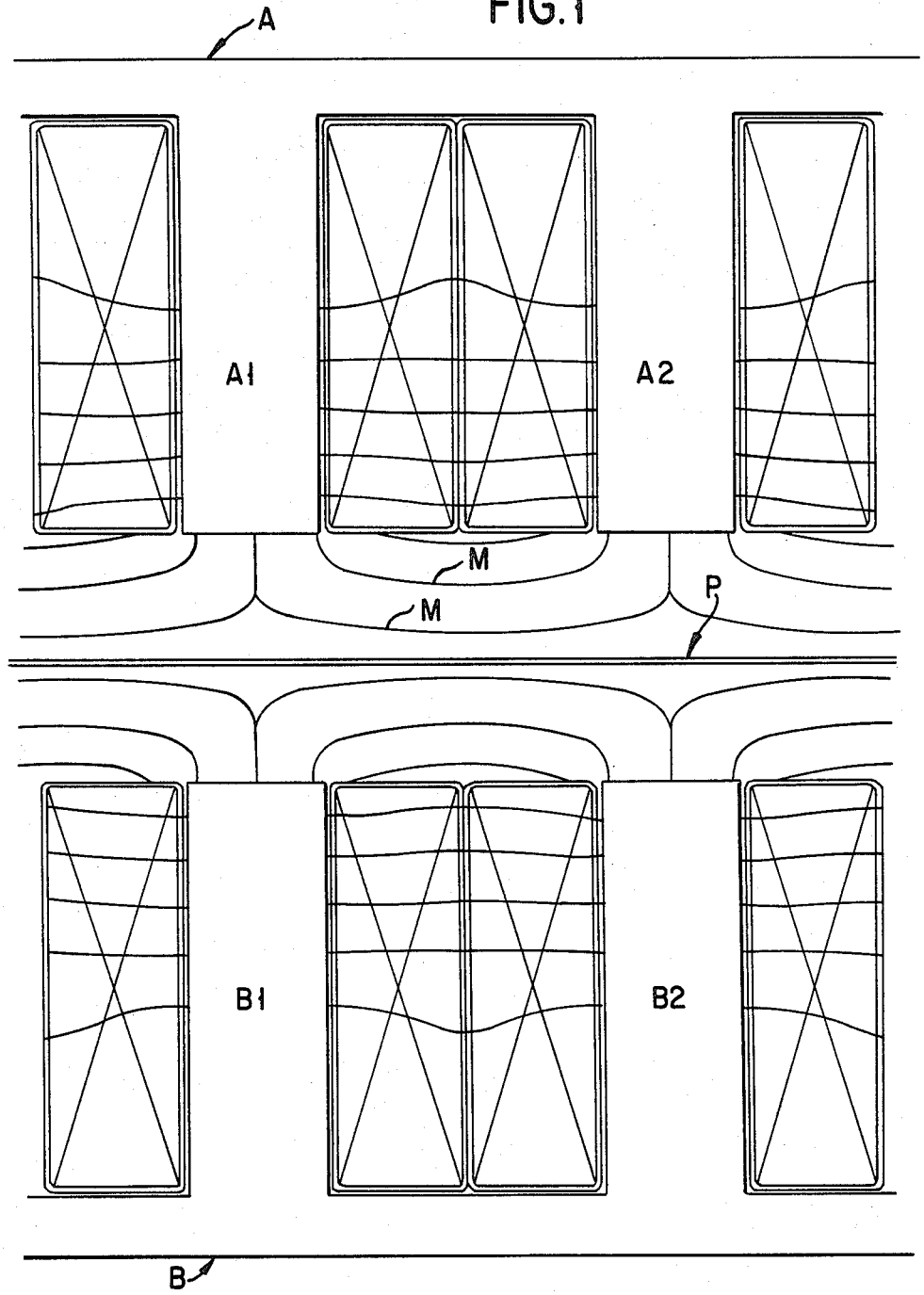
FIG. 1 is a view in elevation of an inductor apparatus suitable for use with the control system of the present invention.

FIG. 1 illustrates one example of an inductor configuration which may be used in connection with the electromagnetic heating control and product positioning system of the present invention. The apparatus of FIG. 1 includes a pair of inductors A and B on either side of the product P with the individual poles A1, A2, . . . AN of the inductor A facing corresponding individual poles B1, B2, . . . BN of the inductor B. The shapes of the poles of the inductors may vary according to the type of product being heated and levitated (or guided) as is described in the previously referenced U.S. patent application of Jean-Claude Bronner, the disclosure of which is incorporated herein by reference.

As is described in the Bronner application, the shape of the magnetic flux in the zone between the inductors may be shaped so as to minimize heating in the product by insuring that the poles facing each other (i.e. the poles A1/B1, A2/B2, etc.) are of the same magnetic polarity while the adjacent poles within an inductor (i.e. poles A1/A2, A2/A3, B1/B2, B2/B3) are of opposite magnetic polarities.

Figure 2:
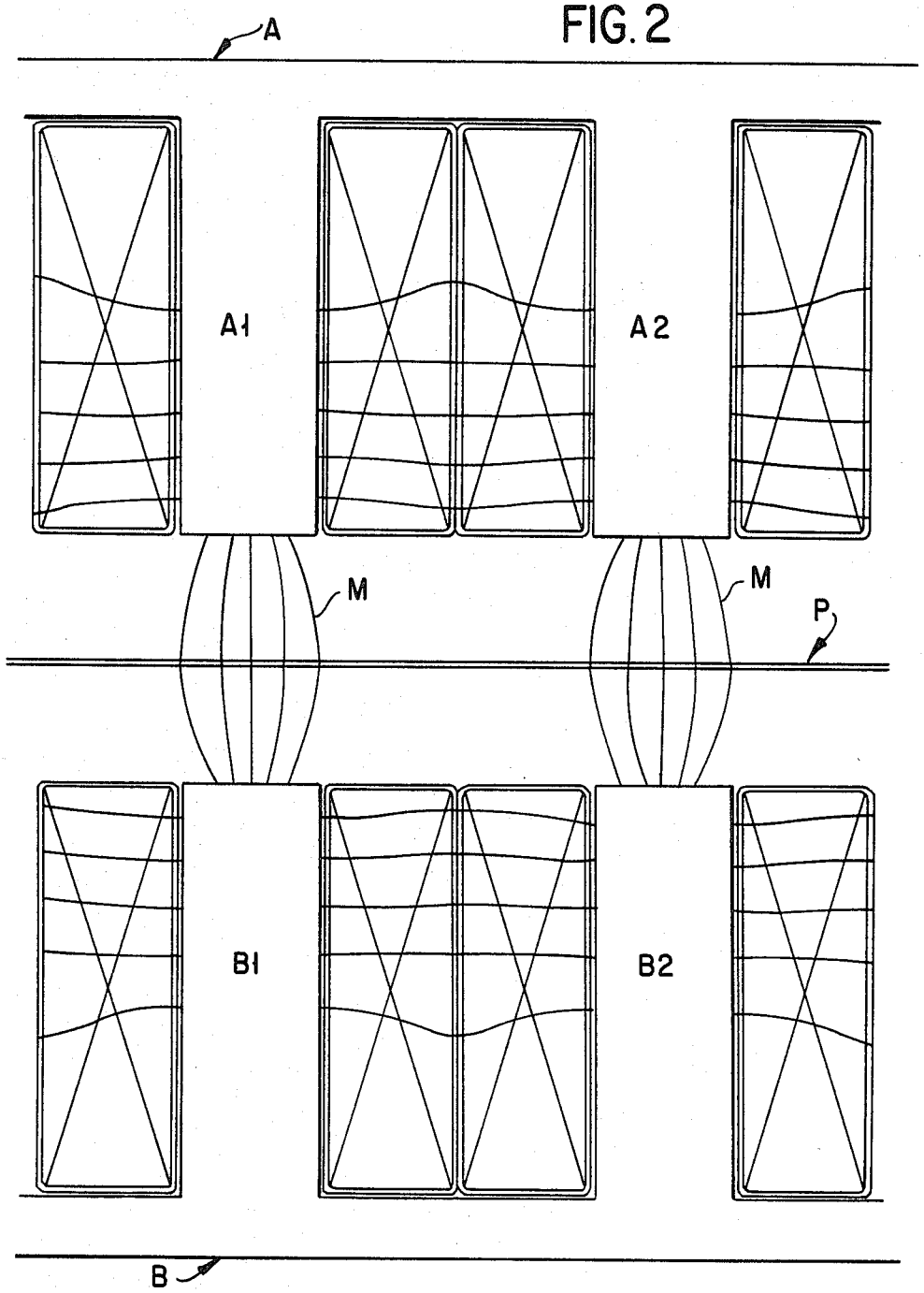
FIG. 2 is a view in elevation of the inductor apparatus of the present invention shown in FIG. 1, in which opposing magnetic poles are of opposite magnetic polarities.

In accordance with the present invention as is described hereinafter in greater detail, the magnetic flux in the zone between the inductors is controlled by inverting the magnetic polarity of selected poles of one inductor relative to the other in accordance with certain parameters to attain a desired heating of the product. For example, the solid lines M between adjacent poles A1/A2, B1/B2 of the inductors illustrates that most of the magnetic flux is parallel to the product in the zone between the inductors when the poles facing each other are of the same magnetic polarity. However, as shown in FIG. 2, when those same poles are of opposite polarities as when the magnetic polarity of a pole of one inductor is inverted by inversion of the power source for that electromagnetic pole, the flux lines M are generally transverse to the product as is illustrated by way of example by the solid lines between poles A1 and B1.

It will thus be appreciated that with controlled inversion of the magnetic polarities of poles of one inductor relative to the other, heating of the product can be controlled in accordance with various control criteria. As is discussed herinafter, the temperature of the product can be sensed in any suitable conventional manner as one control parameter, as can the power supplied to the inductors and thus the power induced in the product. A desired heating curve, derived empirically or theoretically for particular product characteristics, can then be used to regulate the heating of the product.

Figure 3:
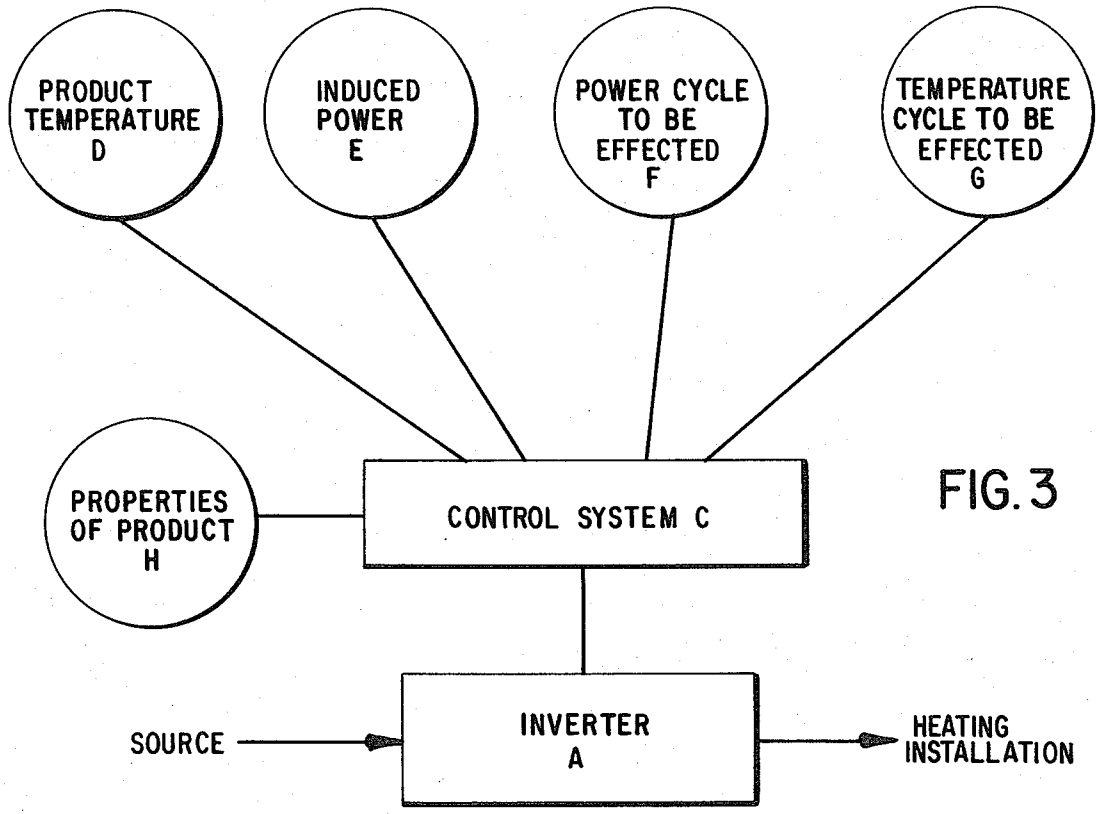
FIG. 3 is a block diagram of the operation of the devices according to one embodiment of the present invention.

Referring now to FIG. 3 wherein a system for controlling heating is illustrated, a device for the operation of the process according to the invention comprises:

necessarily, inverter means A permitting the operation of a sequence of instantaneous polarity inversions of the poles of one of the inductors of the pair with respect to the instantaneous polarity of the corresponding poles of the other inductor and, oepending on the case, a suitable, conventional and preferably electronic control system C (e.g. a microprocessor based controller);

conventional temperature monitoring means D for sensing the temperature of the product;

conventional power monitoring means E for sensing the power induced;

suitable control program means F defining the power cycle to be effected;

suitable control program means G defining the temperature cycle to be effected;

the information, results and data obtained by the above means, together with the properties of the product H which are determinative of its induction heating characteristics, being taken into account by the control system C.

Figure 4:
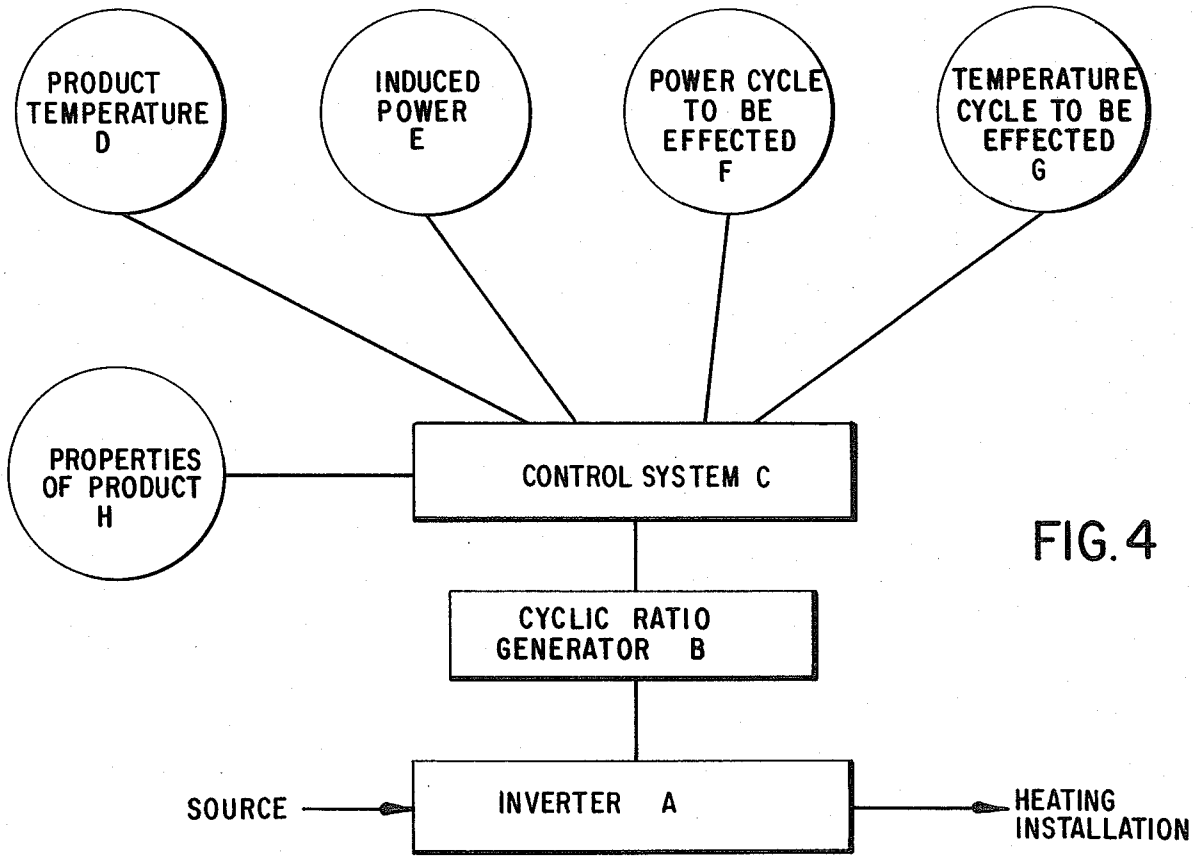
FIG. 4 is a block diagram of the operation of the devices according to an alternate embodiment of the present invention.

According to an alternate embodiment of the invention which is shown in FIG. 4 of the drawings attached hereto, the control device according to the invention may further comprise, interposed between the control system C and the inverter A, a cyclic ratio generator B, the frequency of which is a function of the precision of control desired. This device allows the heating program to follow, in a rigorous fashion, a predetermined temperature curve as a function of time.

According to either embodiment, the polarity inverter A consists of two rectifier bridges connected in parallel but to operate in a mutually exclusive manner so that when one is on the other is off, but this choice is not intended to be limiting. Moreover, the process and the above listed devices are described for the use with a single phase current, but a process and device using polyphase currents are also within the scope of the invention.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Moreover, variations and changes may be made by those skilled in the art without departing from the spirit of the present invention.

What is claimed is:

1. In an electromagnetic induction heating installation comprising a pair of essentially identical inductors placed on either side of the product, the poles of one of the inductors of the pair facing the poles of the other inductor, a process for controlling the average heating power induced by an electromagnetic field in a flat, conducting product positioned without contact by electromagnetic forces correlatively induced by said field, the process comprising effecting a sequence of inversions of the relative instantaneous polarity of the poles of one of the inductors with respect to the instantaneous polarity of the corresponding poles of the other inductor, such that said relative instantaneous polarity of the poles of said one of said inductors is opposite during a first duration and identical during a second duration, with the ratio of the first and second durations determining the average value desired of the heating power induced, the position of the product remaining substantially unchanged by said inversions.

2. Process according to claim 1, wherein a non-uniform distribution of current densities is induced in the product, and wherein the average heating power induced is controlled by said inversions to effect a reduction of said heating power at the end of heating thereby effecting a reduction of hynamic temperature deviations due to said non-uniform distribution of the densities of the current induced.

3. A control system for controlling an electromagnetic induction heating installation having a pair of inductors placed on either side of the product with the poles of one of the inductors facing the poles of the other inductor, the system comprising inverter means for selectively inverting the instantaneous polarity of the poles of one of the inductors with respect to that of the corresponding poles of the other inductor and means for controlling said inverter means as a function of at least one of a plurality of predetermined criteria related to product heating.

4. A control system according to claim 3 wherein the product has properties which are determinative of its induction heating characteristics and further including:

electronic control means for controlling the induction heating of the product including;

means for sensing the temperature of the product;

means for sensing induced power;

means defining the power cycle to be effected;

means defining the temperature cycle to be effected;

information from the sensing and defining means, together with said properties of the product, being used by said control means to control the heating of the product.

5. A control system according to claim 3, including a cyclic ratio generator, the frequency of which is a function of the precision of control desired, for following in a rigorous fashion a predetermined temperature curve as a function of time.

* * * * *